United States Patent [19]

Montonen, deceased et al.

[11] 3,954,180

[45] May 4, 1976

[54] METHOD FOR PACKAGING METAL BARS OR EQUIVALENT, AND MEANS FOR APPLYING THE METHOD

[76] Inventors: Lauri Aleksander Montonen, deceased, late of Imatra, Finland, by Raili Montonen, heiress, Terastehdas B-108, 55610 Imatra 61, Finland

[22] Filed: Mar. 14, 1974

[21] Appl. No.: 451,056

[30] Foreign Application Priority Data

Mar. 16, 1973 Finland ..... 820/73

[52] U.S. Cl. ..... 206/525; 53/216; 229/87 R; 242/54 R

[51] Int. Cl.[2] ..... B65D 85/54; B65D 75/38; B65B 11/04

[58] Field of Search ..... 206/443, 399, 525; 229/89, 87 R; 160/231 R, 120; 242/55.2, 60, 67.1 D, 54 R; 53/390, 216, 219; 217/127, 123

[56] References Cited

UNITED STATES PATENTS

| | | | |
|---|---|---|---|
| 242,785 | 6/1881 | Marks | 229/89 |
| 248,307 | 10/1881 | Grisel et al. | 229/89 |
| 262,353 | 8/1882 | Bell | 229/89 |
| 570,255 | 10/1896 | Kerner | 160/120 |
| 683,264 | 9/1901 | Flemister | 160/231 R |
| 1,112,649 | 10/1914 | Parr | 160/231 R |
| 1,295,712 | 2/1919 | Drew | 160/231 R |
| 1,414,649 | 5/1922 | Jones | 160/231 R |
| 2,525,277 | 10/1950 | Thompson, Sr. | 160/231 R |
| 2,604,984 | 7/1952 | Apgar | 229/87 R |

*Primary Examiner*—George E. Lowrance
*Assistant Examiner*—Allan N. Shoap
*Attorney, Agent, or Firm*—Wigman & Cohen

[57] ABSTRACT

A lath mat for use in a method of packaging elongated bars and the like includes a plurality of spaced laths arranged in parallel relation, the spacing between adjacent laths being greater than the width of one lath. The spaced laths are connected to each other by a strip of flexible material arranged transversely thereof. The packaging method includes wrapping an elongated object with one or more lath mats and interlacing the laths thereof in the spacings between laths.

6 Claims, 2 Drawing Figures

METHOD FOR PACKAGING METAL BARS OR EQUIVALENT, AND MEANS FOR APPLYING THE METHOD

The present invention concerns a method for packaging metals bars or equivalent, and a means for carrying out the method.

It is current practice to use as a packaging material for metal bars wooden crates, which have to be made in advance and in different sizes in order that the packaging process might be expedient. These custom-made different sized packaging crates are not economically profitable, and in addition their storage and use require much space.

It is further known in packaging to use a laminated material comprising two outer flexible coatings and therebetween rather broad parallel longitudinal board elements. This kind of material results in a rigid package but this material is not for all purposes flexible enough to follow the shape of the product to be packed. Also the width of this package has to be adjusted at the stage of manufacture according to the product to be packed.

In order to eliminate these drawbacks a method has now been developed by which metal bars can be conveniently packed in packages facilitating their handling and requiring little space.

The present invention is characterized in that the product to be packaged is at least partially wrapped in a lath mat. A package of greater width is accomplished according to the invention in that several breadths of the lath mat are used, the laths of different mats at least partly interlacing.

The lath mat intended for use in a method according to the invention is characterized in that the mat consists of laths which are connected by at least one strip of webbing running transversely of the longitudinal direction of the laths.

The strip connecting the laths is preferably a strip of plastic having a longitudinal portion of reduced thickness, or a plastic tube split along its length.

Figure 1:
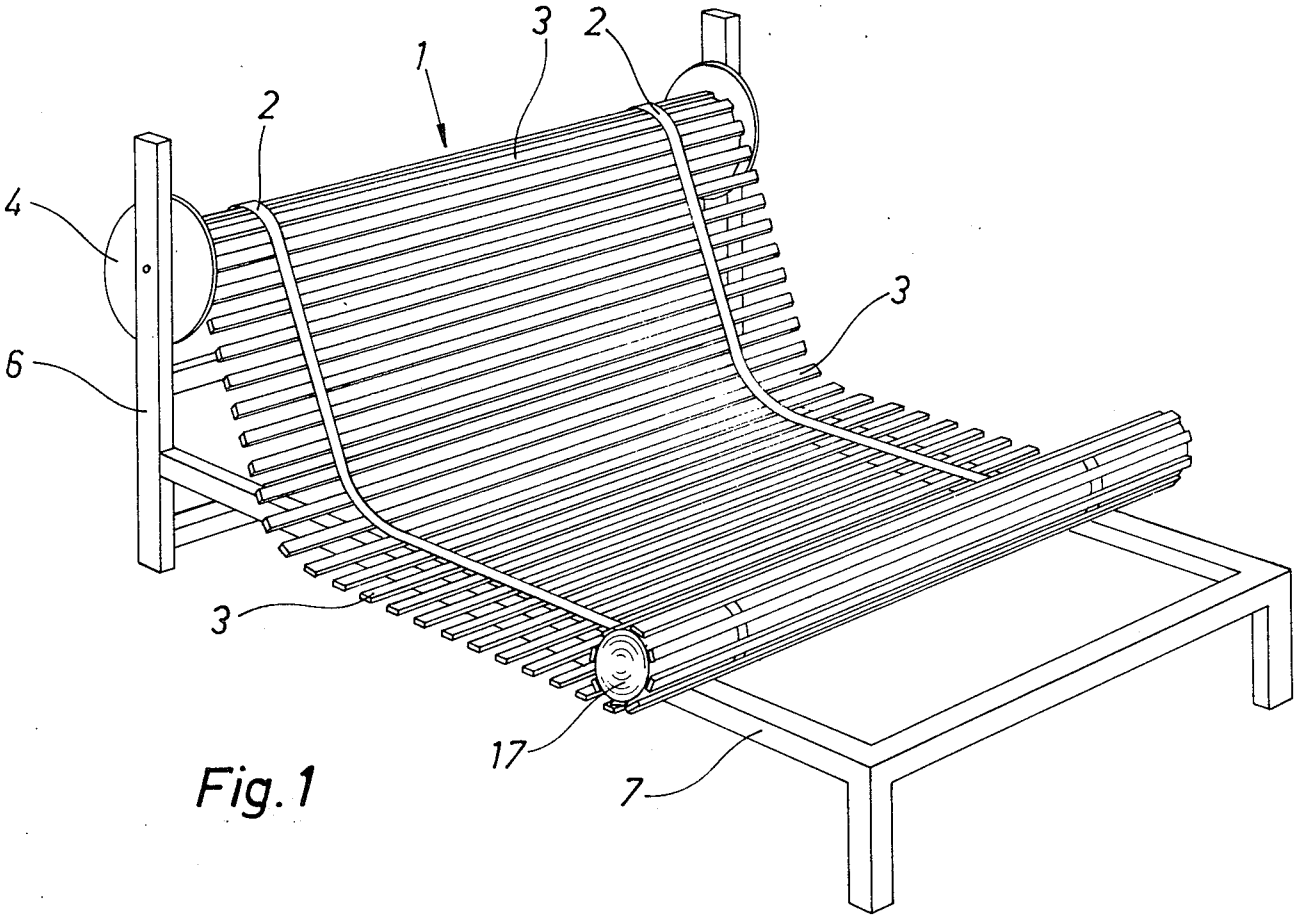
Figure 2:
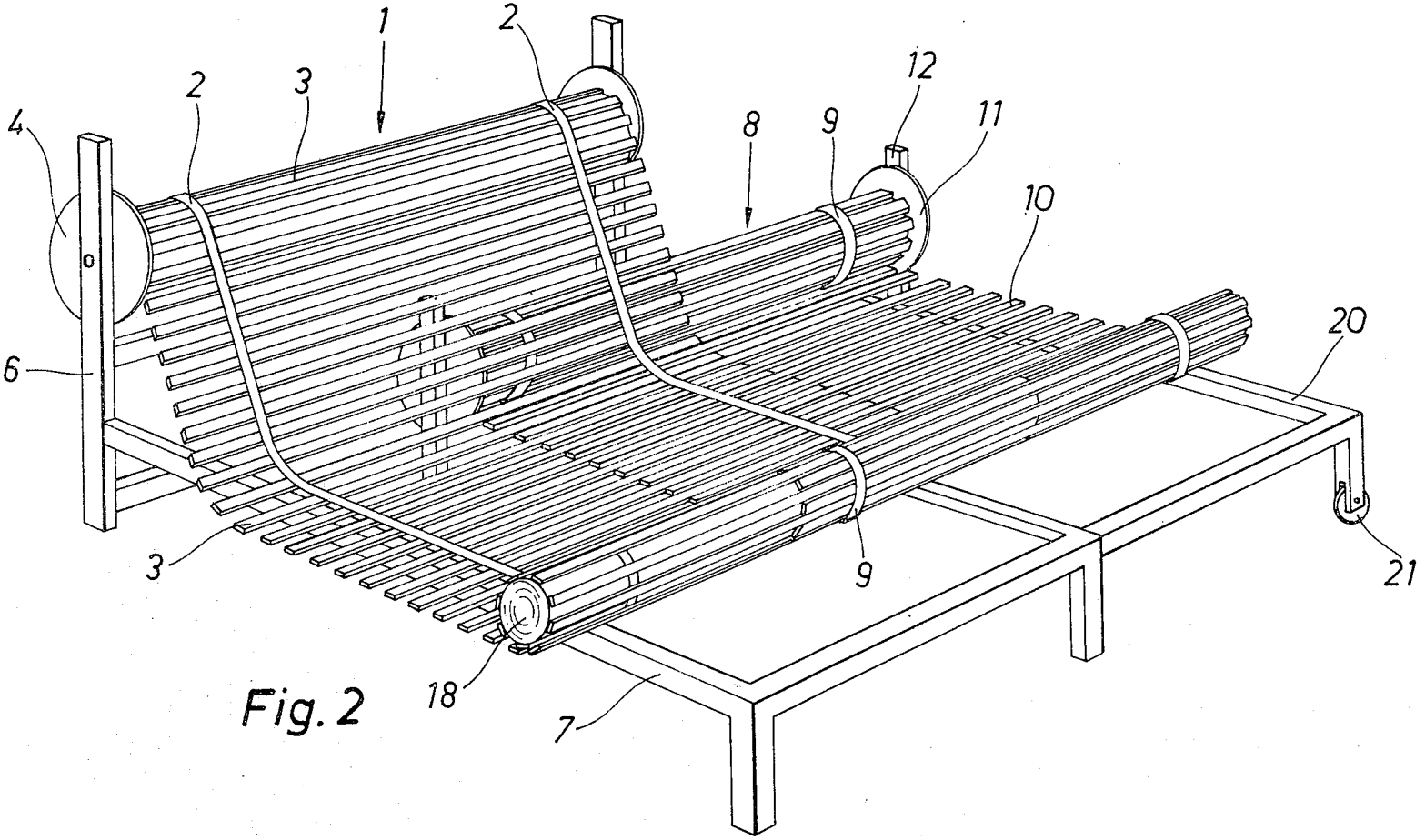

The invention is described in greater detail with reference to the accompanying drawings, wherein FIG. 1 presents a packaging mat used in the method of the invention together with its rack and packaging table, and FIG. 2 shows a packaging method wherein two breadths of lath mat are used.

A simple device for carrying out the metal bar packaging method is seen in FIG. 1. A lath mat 1, having a width consistent with the length of the bars to be packaged, has been wound on a reel 4. The reel 4 has been placed in a rack at one end of the table 7 serving as a packaging table and above its plane.

The mat 1 composed of laths 3 and of strips of webbing connecting these is pulled from the roll 4 onto the packaging table 7. The product to be packaged is placed on the lath mat 1 and the lath mat is cut off so as to give a cut-off length of the mat sufficient for wrapping the product. For ultimate tightening and tying, a metal band or equivalent (not depicted) is tightened around the lath mat. It is advantageous, in order to obtain a sturdy package, to place mats consiting of blocks coincident with the tying band.

In the case presented, the length of the bar to be packaged is approximately consistent with the width of the lath mat 1. However, it is not advantageous in practice to prepare a particular type of lath mat for each product of different length to be packaged. Instead in the case that the length of the product exceeds the width of the lath mat, the packaging is done using two parallelly placed widths of the lath mat so that the laths of the mats at least partially interlace. Such a case is shown in FIG. 2, where to the conventional packaging table 7 with associated rack 5 and mat reel 4 there has been adjoined another movable packaging table 20 having at one end a rack 12 for another reel 11 of lath mat material 8. By moving the rack laterally, the combined width of the mats 1 and 8 can be adjusted to be consistent with the length of the product 18 to be packaged. The laths 10 of the lath mat 8 interlace in this case with the laths of lath mat 1, and the strips of webbing 9 of the mat 8 are on the opposite side of the mat from that of the strips 2 of mat 1.

The width of the combined mat can be adjusted by making the rack 12 to be separate from the packaging table and by providing the rack with wheels. At the same time the packaging table 20 may also be provided with wheels 21, whereby at the same time the width of the packaging table is adjustable.

In case a highly tight and sturdy package has to be obtained, several mats may be used and they may be so disposed with reference to each other that the laths of the mats fully interlace, whereby the package will be tight and uninterrupted. In that case one might for instance in the case shown in FIG. 2 to the closely interlaced portion of the mats 1 and 8 add mat portions interlacing and extending from said portion to the ends.

It is thus understood that the packaging mat used in the method of the invention consists of parallel laths connected by at least one connecting strip of webbing 2, 9 running transversely of the longitudinal direction of the laths. In order that a sufficiently strong, and expedient, package might be obtained, the number of connecting strips of webbing 2 and 9 is two, running parallelly close to the ends of the set of laths 3 and 10. In order that two widths of mat might be easily combinable, the spacing of laths is slightly greater than the width of the laths themselves. In the lath mats shown in the figures, one may for instance advantageously use laths having a width of 50 mm and a spacing between laths of 60 mm.

The packaging of bars may also be accomplished in that to the ends or other appropriate points of the bars narrow mats composed of blocks are applied by wrapping, between which mats the requisite laths may be added.

It should be noted here that the examples described above and illustrated in the figures merely present certain embodiments of the invention. Other embodiments of the invention may appreciably differ from what has been presented above, within the scope of the claims following below. For instance, the strips of webbing may be of a type different from that presented, and their attachment may be e.g. by cementing. The structural details of the mat racks used in the method and of the packaging tables may also appreciably deviate from what has now been presented.

I claim:

1. A packaging article for packaging elongated objects comprising, in combination, at least two lath mats, each comprising a plurality of spaced laths having a predetermined length and width and arranged in substantially parallel relation, the spacing between adjacent laths being greater than the width of one of said laths, a flexible strip disposed transversely of the length of said laths, means for connecting said strip to each of said plurality of spaced laths, said at least two lath mats being arranged in interlacing relation such that at least a portion of the length of each lath of a first one of said lath mats is disposed in a space between adjacent laths of a second one of said lath mats.

2. A method of packaging elongated objects comprising the steps of:

placing an elongated object on a lath mat comprising a plurality of spaced laths having a predetermined length and width and arranged in substantially parallel relation, the spacing between adjacent laths being greater than the width of the laths, said laths being interconnected by at least one flexible strip;

orienting said elongated object to a parallel relationship with said laths;

wrapping said elongated object with said lath mat; and interlacing the laths of a first wrapped layer of said lath mat with laths of a second wrapped layer of said lath mat in the spaces between adjacent laths of said first wrapped layer.

3. A method of packaging elongated objects comprising the steps of:

positioning a first lath mat on a first packaging table, said lath mat comprising a plurality of spaced laths having a predetermined length and width and arranged in substantially parallel relation, the spacing between adjacent laths being greater than the width of the laths, said laths being interconnected by at least one flexible strip;

positioning a second lath mat on a second packaging table adjacent said first packaging table;

interlacing at least a portion of the length of the laths of said first lath mat with at least a portion of the length of the laths of said second lath mat in the spaces between adjacent laths;

placing an elongated object on said lath mats in parallel relation to said laths; and wrapping said elongated object with said lath mats.

4. The method according to claim 3 wherein said first and second packaging tables are movable relatively of each other and including the step of adjusting the length of the interlacing portion of said lath mats by moving said packaging tables relatively of each other.

5. The method according to claim 4 including the step of arranging said first and second lath mats such that a flexible strip of the second lath mat is disposed on a side thereof opposite the side of the first lath mat on which a flexible strip of the first lath mat is disposed.

6. The method according to claim 5 wherein said lath mats are wound on a roll and including the step of withdrawing said lath mats from said roll to position said lath mats on their respective packaging tables.

* * * * *